United States Patent [19]

Sato et al.

[11] Patent Number: 4,639,397

[45] Date of Patent: Jan. 27, 1987

[54] THICK AND THIN FIBER HAVING GROOVES ON ITS SURFACE AND PROCESS FOR PRODUCING THE SAME

[75] Inventors: Yoshiaki Sato; Hisao Suzuki, both of Mishima, Japan

[73] Assignee: Toray Industries, Inc., Tokyo, Japan

[21] Appl. No.: 599,445

[22] Filed: Apr. 12, 1984

[30] Foreign Application Priority Data

Apr. 15, 1983 [JP] Japan ..... 58-65273

[51] Int. Cl.[4] ..... D02G 3/00

[52] U.S. Cl. ..... 428/397; 428/399; 428/400; 428/224

[58] Field of Search ..... 428/399, 400, 397; 264/177, 171

[56] References Cited

U.S. PATENT DOCUMENTS 4,242,405 12/1980 Backno ..... 428/400

4,455,347 6/1984 Ochi et al. ..... 428/400

OTHER PUBLICATIONS

Japanese Laid-Open Publication No. 5921/1982.

Japanese Laid-Open Publication No. 5912/1982.

*Primary Examiner*—Lorraine T. Kendell

*Attorney, Agent, or Firm*—Austin R. Miller

[57] ABSTRACT

The present invention relates to an advanced silky thermoplastic polymer fiber being thick and thin along its axis and having two or more, preferably more than two axially-continuous grooves per filament with the entrance widths of 0.2 to 4$\mu$ and the depths of 0.1 to 1.8$\mu$. The said fiber can be formed by dissolving out at least part of a easily-soluble polymer from a drawn composite fiber comprised of two differently-soluble thermoplastic polymer components, the easily-soluble one of said components having at least two locations with the areas of 0.2 to 4$\mu$ at the periphery of the transverse cross-section thereof and being thick and thin along its axis.

7 Claims, 11 Drawing Figures

THICK AND THIN FIBER HAVING GROOVES ON ITS SURFACE AND PROCESS FOR PRODUCING THE SAME

BACKGROUND OF THE INVENTION

1. Field of the Invention

The invention relates to a fiber suitable for producing an advanced silky knitted or woven fabric with a scroopy handle, an excellent luster, a color depth, a bulkiness and a natural irregularity, and thick and thin along its axis and having specific grooves on the surface, and to a process for producing the same.

2. Description of the Prior Art

A variety of modified shaped fibers are obtainable by a process consisting of producing fibers or fabrics with a easily-soluble polymer located in the vicinity of the surface of a composite fiber comprised of two differently-soluble thermoplastic polymers and then dissolving out the easily-soluble thereof. For example the inventers proposed in Japanese Patent Laid-Open No. 93819/1980 that a modified shaped fiber with a large degree of shape modification is obtainable by dissolving out an easily-soluble polymer having a plurality of locations isolated by a relatively-insoluble polymer from a composite fiber. This fiber however exhibits glitter luster and decreased color depth, although a scroopy handle can be obtained and its knitted or woven fabric is faulty in that any of a bulkiness, a natural irregularity and other properties specific to advanced silky knitted and woven fabrics are not obtained.

Japanese Patent Laid-Open No. 53210/1981 also discloses that a modified shaped fiber is obtainable by dissolving out an easily-soluble polymer located at specific points in the vicinity of the surface. It however has similar faults.

Japanese Patent Laid-Open No. 112535/1981 proposes a fiber having more than six axially-continuous grooves with the widths of 0.1 to 4$\mu$, the depths of 2 to 10$\mu$ and a high water absorption property. It is also faulty in that its color depth is not good because of the deep grooves, and any of a bulkiness, a natural irregularity and other properties cannot be obtained.

Further the inventors proposed in Japanese Patent Laid-Open No. 5912/1982 and Japanese Patent Laid-Open No. 5921/1982 a thread having a scroopy handle, an excellent luster, and grooves on the surface. It is obtained with tapering recesses formed at the transverse cross-section by dissolving out an easily-soluble polymer located in the vicinity of the vertexes of its multilobal shape. However, when knitted or woven into a fabric, this yarn tends to show unsatisfactory bulkiness and a monotonous appearance characteristic of many synthetic fibers.

Silky synthetic fibers are aimed at attaining the same characteristics as silk itself. The fabrics of silk however differ considerably from the knitted and woven fabrics of ordinary modified shaped polyester multi-filament fibers in the degree of scroopy handle, bulkiness and irregularity. Its fabrics become bulky when spaces are formed among fibers by removing sericin in their production process while polyester multi-filament fibers successfully become bulky when a thermal-shrinkage mixed yarn is made. The latter's manufacturing process however is complicated and at a heavy cost. Further, silk fabrics have such an irregularity that so advanced an appearance as not attained by conventional synthetic fibers is presented because their multi-filament fibers have a random irregularity in thickness along their axes. According to the measurement by a method to be described later, they have the Uster Evenness values of 1 to 3% and 10 to 30 and 0 to 5 peaks every 50 m of the Uster Evenness values of 4 to 10% and above 10% respectively.

A number of processes have been proposed for giving an irregularity in thickness to polyester multi-filament yarns through their irregular draw. Most of them form clearly distinctive thick and thin sections along their axes and gives a clear difference of color shade when dyed. These material yarns for advanced knitted and woven fabrics are not always satisfactory because of their large Uster Evenness values of 5 to several ten %.

Japanese Patent Publication No. 7207/1976 discloses a polyester multi-filament fiber having more than three less-than-3 cm long dispersed undrawn sections every 10 cm thereof and the elongations of 35- 70%. It is however faulty in that it shows a considerable difference of physical properties, particularly of large Uster Evenness value, between the thick and thin sections because its low-speed spinning yarns are irregularly drawn and a considerable difference of color shade when dyed and are susceptible of the variation of the tension in their textile process because of their large elongations.

Further Japanese Patent Laid-Open No. 116819/1980 discloses a thick and thin yarn obtained by a process consisting of composite spinning a core component of polyethylene terephthalate and a sheath component of a mixture of polyethylene terephthalate and a ionic dyeable polyethylene terephthalate copolymer and drawing this composite fiber at a temperature less than 75° C. This too is not satisfactory as a material of advanced silky knitted and woven fabrics because it is aimed at producing varied dyeability effects and at a clear difference of color shade between the thick and thin sections and cannot be provided with any excellent luster.

As described heretofore, prior arts have not succeeded in obtaining any material yarn capable of providing a scroopy handle, a crisp hand, a rustle, an excellent luster, a color depth, a bulkiness and natural irregularity specific to advanced silky knitted and woven fabrics at the same time.

SUMMARY OF THE INVENTION

An object of the invention is to provide a material yarn capable of presenting a scroopy handle, a crisp hand, a rustle, an excellent luster, a color depth, a bulkiness, and a natural irregularity specific to advanced silky knitted and woven fabrics at the same time, and a process for manufacturing the same.

The first phase of the invention provides a thermoplastic polymer fiber being thick and thin along its axis and having two or more, and preferably more than two axially-continuous grooves with the entrance widths of 0.2 to 4$\mu$ and the depths of 0.1 to 1.8$\mu$ per filament. It is most characteristic of the axial thickness and thinness and a specific number of grooves with specific sizes.

The second phase of the invention provides a process suitable for producing the above mentioned fiber. Therein the grooves with the entrance widths of 0.2 to 4$\mu$ and depths of 0.1 to 1.8$\mu$ are formed by dissolving out at least part of an easily-soluble polymer having at least two and preferably more than two locations with widths of 0.2 to 4$\mu$ at the periphery of the transverse cross-section from an axially thick and thin drawn composite fiber yarn comprised of two differently-soluble thermoplastic components.

DESCRIPTION OF THE PREFERRED EMBODIMENTS

The object stated hereinbefore of the invention is attainable by a thermoplastic polymer fiber being thick and thin along its axis and having at least two preferably more than two axially-continuous grooves with the entrance widths of 0.2 to 4μ and the depths of 0.1 to 1.8μ per filament on the surface.

The preferable process for obtaining a fiber being thick and thin and having grooves on the surface in accordance with the invention is that of forming grooves with the entrance widths of 0.2 to 4μ and the depths of 0.1 to 1.8μ by dissolving out at least part of a easily-soluble polymer having at least two locations with the areas of 0.2 to 4μ at the periphery of the transverse cross-section from a axially-thick and thin drawn composite fiber yarn comprised of two differently-soluble polymer components.

Figure 1A:
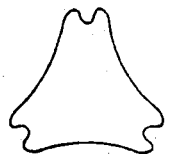
FIGS. 1(A) and 2 show the representative transverse cross-sections of the fiber in accordance with the invention.
Figure 1B:
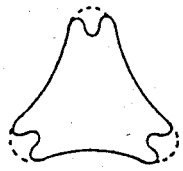
FIG. 1(B) is the transverse cross-section of the fiber of FIG. 1(A) showing in broken lines the assumed shape of the fiber if it had no grooves on the surface.
Figure 2:
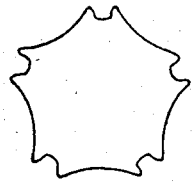

One of the features of the fiber in accordance with the invention is the shape of the axially-continuous grooves. It will be described hereinafter in connection with the drawings. FIGS. 1 (A) and 2 show the examples of the preferable transverse cross-sections of a fiber having grooves on the surface. The former has three grooves formed at almost equal intervals at the periphery. A transverse cross-section assumed to have no groove, shown in FIG. 1(B), has a trilobal shape of which grooves are formed in the vicinity of the vertexes. The FIG. 2 has five grooves formed at almost equal intervals at the periphery. A transverse cross-section assumed to have no groove has a pentalobal shape of which grooves are formed in the vicinity of the vertexes.

Figure 3:
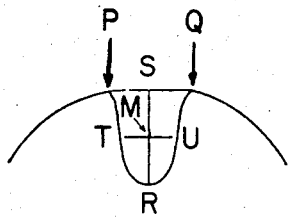
FIG. 3 is an enlarged partial view of the transverse cross-section illustrating the shape of grooves.

FIG. 3 shows the shape of grooves of a fiber. The entrance width is the length of the common tangent PQ across the periphery in their vicinity and the depth is a line segment interconnecting the center S of the common tangent PQ and the point R the closest to the center of gravity on the surface of a groove. The invention requires the entrance width to be 0.2 to 4μ and depth to be 0.1 to 1.8μ. If the former is contrary, no or a very small improvement is found in color depth. It is required to be preferably 0.3 to 3μ, more preferably 0.4 to 2μ.

The shape of grooves is expressed in terms of the mean value obtained by measuring all of them on the 20 filaments selected at random. Their depth is preferably required to be 0.2 to 1.6μ. The increase therein raises scroopy handle. A scroopy handle is however obtainable when it is larger than about 0.2μ. The improvement in color depth, on the other hand, is zero or very small when it is as small as less than 0.1μ, becomes small with its increase above about 1μ, and becomes very small when it is larger than 1.8μ. It is necessary to provide two or more than two grooves per filament in accordance with the invention. In case of one groove per filament, the probability of its presence on its surface is too low for a considerable improvement in color depth and scroopy handle on the fabric made of the fiber. It is however preferable and more preferable to provide less than 15 grooves and, 3–12 grooves respectively. On the contrary the surface of the other parts than grooves of the fiber decreases in luster. The intersections of the straight line passing the center M of line segment SR to orthogonally interesect it with the faces of grooves assumed to be T and U. For preventing glitter and for an improvement in color depth with a decrease of the reflection of the faces PT and QU, it is preferable that the length of line segment TU corresponds to 40–90% of that of line segment PQ, thereby making grooves tapering toward the center of gravity of the fiber. For providing an excellent luster, it is preferable that the sum of the lengths of the line segments PQ of grooves is required to be preferably 2 to 40% more preferably 5 to 35%, of the peripheral length of the other parts than grooves of the fiber.

A modified shape effect can be produced, particularly a silky luster can be given, by modifying the transverse cross-section where no groove is assumed to be present. All known modified shape sections are applicable to the invention. For providing a silky luster, however, the fiber is preferably required to have a T-type or 3–6 lobal shape. For considerable improvement in scroopy handle and color depth, it is preferable to locate at least one groove in the vicinity of the vertex of the modified shape section. For a considerable improvement in the depth of color and scroopy handle, it is not always necessary to make this location in the vicinity of all the vertexes of the modified shape section but preferable and more preferable to make it in the vicinity of the majority and all respectively thereof. It is preferred not to locate grooves on the recessed face between the vertexes of the modified shape section because fibrillation is liable to occur. The transverse cross-section assumed to have no groove is assumed to be the fiber surface at line segment PQ without groove face PTRUQ. The vertexes of a modified shape section are the points most distant from the center of gravity of fibers on the outwardly-raised surface when viewed therefrom and wording "present in the vicinity of the vertexes" is "present at and around the vertexes".

The state of the side faces of grooves and the other parts is not limited. For an improvement in color depth, however, it is preferable to provide more than five recesses per 10μ in the right angle direction to the fiber axis with the widths of 0.1 to 1μ and the lengths less than 5μ along its axis of a fiber produced by treating a polyester fiber with an aqueous alkaline solution.

It is preferred not to form a number of streaky concaves and fine concave-convexes because a decrease occurs in luster. For an increase in color depth without any small decrease in luster, however, it is preferable to form streaky concaves and fine concave-convexes on only the faces of grooves.

The fiber having grooves on the surface in accordance with the invention is characteristic of being thick and thin along its axis. For providing an irregularity similar to that of silk, the Uster Evenness value obtained by the measuring method to be described later can be fixed at 0.7 to 2.5% and it is more preferable to fix it at 0.9 to 2.2%; it is preferable to fix the number of the peaks within the Uster Evenness Value range of 4 to 10% at 5 to 80 every 50 m, more preferable to fix it at 10 to 50 and furthermore preferable to fix the number of the peaks within the Uster Evenness Value range above 10% at less than 10 every 50 m. It is not preferable to fix the Uster Evenness Value above 3% because a difference of internal structure between the thick and thin sections causes a considerable difference of dyeing degree to result in so-called thick and thin yarn that provides another appearance than silky.

A fiber having the Uster Evenness values of 0.7 to 2.5% and being thick and thin is susceptible of a natural irregularity, a bulkiness and a good color depth. Bulkiness can be expressed in terms of the bulkiness degree to be obtained by applying a measuring method to be described later. It is preferable to fix it at more than 10 cc/gr. and more preferable to fix it above 12 cc/gr. Such a bulkiness effect on the knitted and woven fabric can cause an improvement in color depth. The reason for this is not definitely known but is considered to be the trap effect of the incident light to the surface of knitted and woven fabric by the clearances among the filaments. Namely in the case of the yarn being thick and thin having grooves on the surface in accordance with the invention, it is considered that their specific shape, thickness and thinness, and the clearances among the filaments can effect a considerable improvement in color depth.

Hereinafter description will be proceeded to the second phase of the invention which provides a process suitable for manufacturing the fiber stated hereinbefore which is thick and thin and has grooves on the surface. The second phase relates to a process for producing a fiber being thick and thin and having grooves on the surface, which is characterized in that grooves with the entrance widths of 0.2 to 4μ and the depths of 0.1 to 1.8μ are formed by dissolving out part of the easily-soluble polymer having at least two locations with widths of 0.2 to 4μ at the periphery of the transverse cross-section from a drawn composite fiber yarn being comprised of two differently-soluble thermoplastic polymer components and being thick and thin along its axis.

Hereinafter description will be carried out as to the undrawn composite fiber before that of the manufacturing process in connection with its flow. It is obtainable by applying the processes which the inventors previously propose in Japanese Patent Laid-Open No. 5912/1982 and Japanese Patent Laid-Open No. 5921/1982.

It is preferable to fix the speed of spinning the composite fiber at 2,000–4,000 m/min. and more preferable to fix it at 2,500–3,500 m/min. If the spinning speed is below the values, only a low-tenacity thick and thin fiber is producible and a silky irregularity is difficult to obtain because an excessive difference is between thickness and thinness. If the spinning speed is above the values, thickness and thinness are too small to obtain a silky irregularity.

Conventional drawing apparatuses are applicable to the low draw-ratio draw of the composite polyester fiber for obtaining the thick and thin drawn fiber. Particularly in the case of composite polyester fibers, the combination between hot pins and hot plates or between hot rollers and hot plates is preferable for forming thickness and thinness steadily along the axis although it is not necessary if a proper quantity thereof are installed between the rollers for the feed and constant draw-ratio take-up at a constant speed. For obtaining the thick and thin drawn yarn, the draw-ratio should preferably be fixed below (1+elongation at natural draw zone×2.2). It is preferable to fix the draw-ratio at (1+elongation at natural draw zone× 1.1) to (1+elongation at natural draw zone×2.2) for fixing the Uster Evenness Value of the drawn thick and thin yarn suitable for fixing at 0.7 to 2.5% that of the fiber having grooves on the surface at 0.7 to 3.0% and at (1+elongation at natural draw zone×1.3) to ( 1+elongation at natural draw zone+2.0) for fixing that at 0.9 to 2.5% and more preferable to cause the drawn yarn with the draw-ratios of (1+elongation at natural draw zone×1.4) to (1+elongation at natural draw zone×2.0) to present no elongation at the natural draw zone at its S-S curve, show the elongations of 20 to 35%, present a proper irregularity, improve in textile process passability and become unsusceptible of the variation of the tension in the textile process. Draw start temperature T (°C.) should preferably be fixed at the range calculated by using expression:

$$T \leqq \frac{30 + 143x(\text{Elongation at natural draw zone}) - 30x(\text{Draw-ratio})}{1.1x(\text{Elongation at natural draw zone})}$$

for fixing at 5 to 100 every 50 m the number of the peaks within the Uster Evenness Value range of 4 to 10% of the thick and thin drawn yarn suitable for fixing that of the fiber having grooves on the surface at 5 to 80 every 50 m.

The shrinkage in the boiling water of the drawn yarn by the combination between hot pins and hot plates or between hot rollers and hot plates is controllable by means of hot plate temperature. A hot plate temperature of 100°– 160° C. is preferable to produce a boiling water shrinkage of 4–18% which is suitable for the composite polyester fiber. It is also effective for preventing such a fault of the woven or knitted fabric of an ordinary thick and thin yarn for example that it causes a crape when dyed.

Figure 4:
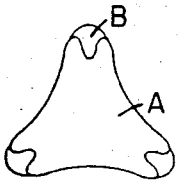
FIGS. 4 and 5 show the examples of the transverse cross-sections of the composite fiber in accordance with the invention.

The thick and thin composite fiber can be made increasingly bulky with the increase in the degree of bulkiness. It is therefore preferable to fix it above 10 cc/gr. and more preferable to fix it above 12 cc/gr. Next, description will be proceeded to the shape at the transverse cross-section of the thick and thin composite fiber. FIG. 4 shows a 2-component composite fiber trilobal shape yarn whose easily-soluble polymer B has three locations isolated by relatively-insoluble or insoluble polymer A in the vicinity of vertexes of the section. The easily-soluble polymer on the surface of such 2-component composite fibers is required to have the lengths of 0.2 to 4μ and form grooves with the entrance widths of 0.2 to 4μ and the depths of 0.1 to 1.8μ when at least part thereof is dissolved out. The length corresponds to that of the line segment interconnectiong the boundary points between it and the relatively-insoluble or insoluble polymer on the surface. If it is smaller than 0.2μ or larger than 4μ, no or a very small improvement can be made in color depth when grooves are formed by dissolving out at least part of the easily-soluble polymer. It should be fixed preferably from 0.3 to 3μ and more preferably from 0.4 to 2μ. It is preferable to fix the sum of the lengths of the easily-soluble polymer at 2 to 40% of the peripheral length of the other polymer and more preferable to fix it at 5 to 35% of the same for providing an excellent luster when a fiber having grooves on the surface is obtained by dissolving out at least part of the easily-soluble polymer. Such a fiber having grooves on the surface as shown in FIG. 1 is producible by dissolving out the easily-soluble polymer from such a 2-component composite fiber as shown in FIG. 4. The locations of the easily-soluble polymer are not limited in the fiber. They may be satisfactory deep in the fiber or the easily-soluble polymer having the deeper locations may be combined. However it should be preferably made tapering inward of the fiber. As described hereinbefore, it is particularly preferable to locate the easily-soluble polymer so that the length of line segment TU corresponds to 40 to 90% of that of line segment PQ and grooves are shaped tapering toward the center of the fiber when the fiber having grooves on the surface is obtained by dissolving out at least part of the easily-soluble polymer. Further it is preferable from the standpoint of the steady spinning of the composite fiber to make the easily-soluble polymer symmetric with respect to the rotation axis passing the center of gravity of the fiber.

A modified-shaped transverse cross-section effect can be produced, particularly a silky luster can be provided, for the composite fiber in accordance with the invention by giving a modified shape transverse cross-section to the aforementioned composite fiber. All known modified shaped transverse cross-section are applicable. For providing a silky luster, however, it is preferable to select a T-type or 3- to 6-lobal transverse sections. The invention ensures a considerable improvement in color depth and scroopy handle when specific grooves aforementioned are formed by dissolving out at least part of the easily-soluble polymer whose surface forming part is located in the vicinity of the vertexes of a modified shape transverse cross-section from the composite fiber.

Next, description will be proceeded to the easily-soluble polymer and to the relatively insoluble or insoluble polymer covering all or the greater part of the fiber having grooves on the surface. They may be properly selected from known thermoplastic polyamides, polyesters and polyolefins in connection with a solvent to be used. If immiscible polymers are used in combination, however, separation occurs therebetween so that fuzz, fiber break and so forth are liable to take place in fiber-manufacturing and textile processes. It is therefore preferable to select a combination of miscible polymers. Term "miscible" means that no substantial separation is observed in the drawn composite fiber.

Preferable relatively-insoluble or insoluble polymer is polyester which is superior in physical and chemical properties, extensively used for clothings, and ensures a considerable improvement in color depth. In the case of the methods for dissolving out the easily-soluble component from the composite fiber, it is preferable to select an aqueous alkaline solution out thereof in view of its facility of operation, safety and cost. From this standpoint, easily-soluble polymer should preferably be selected from an alkali-soluble polymers. Easily-alkali-soluble polymers include the copolymers or blendings between polyester and polyalkyleneglycol derivatives, anionic-surfactants added polyesters, and the blendings between the polyesters containing metal sulfonate groups and polyesters, or the polyesters containing metal sulfonate groups. Among the easily-soluble polymers the blendings between the polyesters containing metal sulfonic groups and polyesters or the polyesters containing metal sulfonate groups are preferable for their easy uniform dissolving out of the composite fiber. Particularly preferable among the polyesters containing metal sulfonate groups are 5-sodium-sulfoisophthalate (1 to 10 mole%)/ethyleneterephthalate (99 to 90 mole%) copolymer polyester.

The fiber having grooves on the surface in accordance with the invention is not obtainable unless the ratio of dissolution speed of the easily-soluble polymer to the relatively-insoluble or insoluble polymer is more than 1. It should be fixed preferably above 1.5 and more preferably above 2. Particularly it should be fixed preferably at 1.5 to 8 and more preferably at 2 to 6 for the aqueous alkaline solution treatment most suitable for dissolving out at least part of the easily-soluble polyester from the composite fiber in accordance with the invention. It is preferable to form the recesses with the widths of 0.1 to 1μ and the lengths less than 5μ along the axis at the rates of more than five to a length of 10μ orthogonally with the axis on the surface of the fiber formed through the aqueous alkaline solution treatment of an ordinary polyester fiber on the side faces of the other parts than the grooves on the surface of the fiber by dissolving out more than 6% of the relatively-insoluble polyester.

In other words, the aqueous alkaline treatment is preferably so controlled to dissolve out also more than 6% of the relatively insoluble polyester, thus forming a certain number of recesses with widths of 0.1 to 1μ and lengths of less than 5μ along the axis, there being more than 5 of these recesses per 10μ orthogonal to the fiber axis on the surface of the fiber except grooves.

The composite-fiber forming thermoplastic polymer may contain such amounts of delusterants, antioxidants, fluorescent brighteners, ultraviolet absorbers and other additives as not affecting the effects in accordance with the invention.

The composition ratio by weight of the easily-soluble polymer to the relatively-insoluble or insoluble polymer is preferable to fix at 2 to 98 through 30 to 70 and more preferable to fix it at 5 to 95 through 20 to 80, thereby obtaining the fiber having grooves on the surface through dissolving out all the former, for ensuring the uniform dyeing of the fabric.

The fiber having grooves on the surface in accordance with the invention is preferably a filament type one with 0.5 to 10 denier suitable for ordinary clothings. It is usable in the form of denier mixes, thermal shrinkage mixes and cross-section shape mixes, or after mixed with other fibers.

Although the composite fiber may be alkali-treated prior to weaving or knitting, the composite fiber should preferably be alkali-treated after weaving or knitting.

The fabric, so alkali-treated after being woven or knitted, is more bulky and exhibits a softer hand as compared with the fabric woven or knitted from alkali-treated fibers, because clearances among the filaments are formed thereamong. Furthermore, the efficiency of an alkali-treated treatment is greater after weaving or knitting than before weaving or knitting. In the case where the fabric is alkali-treated after being woven or knitted, it is preferable that the fabric be, prior to the alkali-treatment, subjected to scouring and, then, a dimensional stabilization heat treatment under conditions such that no crape defect occurs in the fabric.

An aqueous alkaline solution is preferable for dissolving-out treatment as described hereinbefore. The alkali-treatment of the fiber or fabric is generally carried out by using a jigger, a wince, a beam, a suspended tank or any other known means.

In order to enhance dissolution of the soluble polymer component, an additive, such as a phenol compound, an amine compound, a quaternary ammonium salt or a high-boiling point polyhydric alcohol, may be incorporated in the aqueous alkaline solution. Among alkaline metal hydroxides, sodium hydroxide is preferable in view of its low cost and enhanced capability for dissolution of the soluble component. The aqueous alkaline metal hydroxide solution is used, preferably, at a concentration of from 0.5 to 20% by weight and the temperatures from 70° to 120° C.

As described herebefore, the fiber being thick and thin and having grooves on the surface in accordance with the invention is suitable as the material yarn of the advanced silky woven or knitted fabric having a scroopy handle, an excellent luster, a color depth, bulkiness and a natural irregularity. Its manufacturing process may be used without any special systems or conditions.

Hereinafter the invention will be described in further details in connection with its examples. The methods of measuring elongation at natural draw zone, Uster Evenness Value, bulkiness degree and color depth follow.

[Elongation at natural draw zone]

Figure 6:
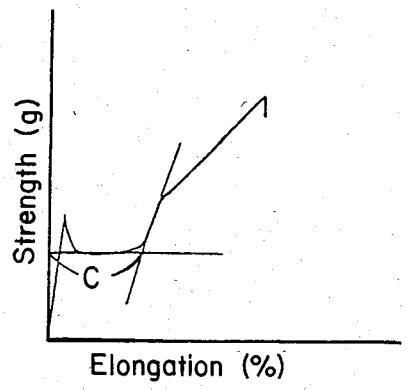
FIG. 6 shows a stress-strain curve illustrating the elongation at the natural draw zone.

The elongation of C on a chart shown in FIG. 6 which is obtained by using an instron tensile tester is read. For example "40%" is "0.4".

[Uster Evenness Value %]

Normal test measuring is carried out by using a commercially-available Uster Evenness Tester (manufactured by Keisokuki Kogyo K.K.) during the twisting at about 1,500 rpm by a twister with a measuring slotter selected in accordance with the total denier of the yarn and its speed fixed at 25 m/min. Uster Evenness curves are be drawn at a chart speed of 5 cm/min and a range of ±12.5%. The accessory integrator is used to read the Uster Evenness Value in terms of the value of the irregularity of the yarn for three minutes. Three minutes' measuring is carried out at least five times and Uster Evenness value is expressed in terms of its mean value.

The number of Uster Evenness Value peaks is obtained by reading their size in terms of the difference between their upper and lower ends on the aforementioned measuring chart. At least five measurings are obtained for 50 m and their mean value is calculated.

[Degree of bulkiness]

Figure 7:
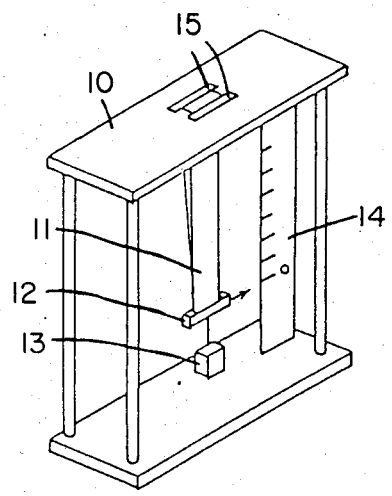
FIG. 7 is a sketch of fiber bulkiness measuring equipment.

A perspective view of a device for measuring the degree of bulkiness is shown in FIG. 7 and that of the method of the measuring thereby in FIG. 8. This device comprises a sample table 10 which has an upper plate with a pair of spaced apart parallel openings 15. The spacing 16 between the outside edges of the openings 15 is selected to have a length of 6 mm. An upper end of a flexible tape 11 having a width of 2.5 cm made of a thin fabric is positioned to loop around the openings 15. A member 12, which is provided with an indicator needle and a weight 13, is secured to a lower end of the tape 11. A scale 14 is positioned so that the needle of the member 12 indicates zero (cm) when no sample is placed on the table 10.

Figure 8A:
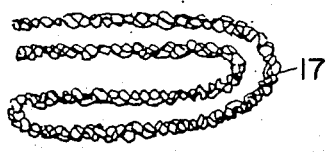
FIGS. 8(A), (B) and (C) are the sketches illustrating fiber bulkiness measuring methods.
Figure 8B:
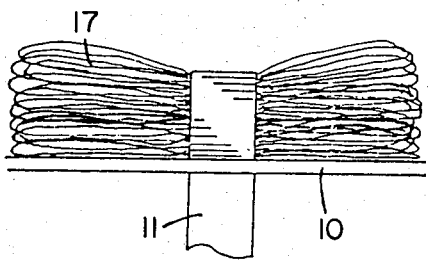
Figure 8C:
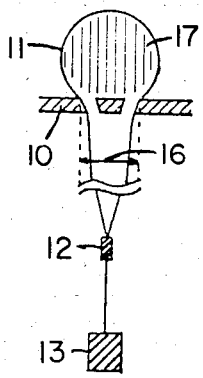

Samples in the form of hanks each having 80 windings are prepared by using a reel which has a peripheral length of 1 meter. The number of hanks to be prepared should be between 2 and 10 in accordance with the yarn's denier number. The hanks which are hung in a no-load condition are subjected to heat treatment in the atmosphere at a temperature of 200±2° C. for five minutes. Next, the heat-treated hanks are bundled together in parallel so that the total denier is equal to 48,000. (For example, when a yarn of 30 denier is used, $30\times80\times2=4{,}800$, and therefore $48{,}000\div4{,}800=10$ hanks; when a yarn of 75 denier is used, $75\times80\times2=12{,}000$, and therefore $48{,}000\div12{,}000=4$ hanks.) The parallel bundled hanks are folded into four parts as shown in FIG. 8(A) to form a sample 17. The sample 17 is inserted between the tape 11 and the sample table 10 as shown in FIG. 8(B) front view and FIG. 8(C) sectional view. Needle indication L(cm) is read with the weight 13 so controlled that the total weight of it and the number 12 is fixed at 50 gr. Three different values L are measured by changing the position of the sample 17. Next, a mean value L (cm) of the values L is calculated. The degree bulkiness M is calculated from the following equation:

$$M(\text{cc/g}) = \frac{\text{Volume of the yarn } (V)}{\text{Weight of the yarn } (W)} = \frac{V}{W}$$

$$V = \frac{(\bar{L})^2}{\pi} \times 2.5$$

$$W = \text{D} \times \frac{100}{100 - SH} \times P \times 0.025 \times \frac{1}{9{,}000}$$

wherein D is the denier of the yarn before heat treatment; P is the number of the filaments in the yarn; and SH is the shrinkage (%) in dry heat, which is obtained by measuring, before and after the heat treatment, the lengths of the hanks under a load of 0.1 gr./d.

[Depth of color]

A fabric comprised of a fiber sample to be measured was subjected to a normal method of scoring in the boiling water containing 0.2% of nonionic surfactant "Sandet" G-900 (manufactured by Sanyo chemical Ind. Ltd.) and 0.2% of soda ash for five minutes, rising in water, drying and dyeing.

The dying was continued for 60 minutes in a 130° C. aqueous solution with a bath ratio of 1 to 30 of 10% owf of disperse dye Sumikaron Black S-3B, 0.5 cc/lit. of acetic acid and 0.2 gr./l. of sodium acetate. Thereafter it was subjected to an ordinary method of reductive washing in an 80° C. aqueous solution of 2 gr./l. of hydrosulfite, 2 gr./l. of caustic soda, 2 gr./l. of the non-ionic surfactant (Sandet G-900) for 20 minutes, drying and 200° C. dry heat treatment for five minutes.

The depth of color was measured in terms of the L-value by using a color computer AUD-SCH-2 Type (manufactured by Suga Test Instruments Co., Ltd.) with more than five pieces of the fabric put one upon another so that no radiant light transmitted them. The L-value decreased or increased with the increase or decrease respectively in depth of color.

EXAMPLE 1

Figure 5:
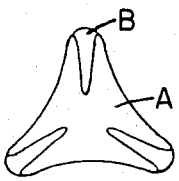

An undrawn yarn having 24 filaments with 120 denier and an elongation at natural draw zone of 42% was obtained through the melt-spining by using a composite spinning apparatus of 5-sodium sulphoisophthalate (1.6 mole%) -ethyleneterephtalate (98.4 mole%) copolymer polyester (intrinsic viscosity in 25° C. orthochlorophenol-0.54, containing 0.2% of titanium oxide) as easily-soluble polymer and polyethylene terephthalate (intrinsic viscosity-0.65, containing 0.03% of titanium oxide) as relatively-insoluble polymer at a temperature of 295° C. and at a spinning speed of 3,000 m/min. The ratio of dissolution speed between the both was 3.4 in terms of the dissolution condition to be described later. The yarn was drawn at a rate of 300 m/min. and a draw-ratio of 1.7 with the temperature of hot pin fixed at 60° C. and that of hot plate fixed at 120° C. so that a drawn yarn having such a sectional shape as shown in FIG. 5 and being thick and thin was obtained. It showed 1.2μ length on the surface of the fiber of the easily-soluble polymer, 4.8μ distance between the points closest and most distant to its center of gravity in the easily-soluble polymer, 32% elongation with the substantial absence of that at natural draw zone at S-S curve, 11% shrinkage in boiling water, 21 cc/gr. degree of bulkiness, 1.4% Uster Evenness Value and 21 peaks/50 m at the range 4 to 10%.

A 28G single jersey knit of a thick and thin drawn yarn was subjected to scoring, 160° C. intermediate setting and the 80° C. treatment with an aqueous alkaline solution of 30 gr./lit. of NaOH by changing its time so that a fiber having the depths shown in Table 1 on the surface. All the obtained samples thereof showed the groove entrance widths of 1.2 to 1.4μ, 70 to 85% ratios of the line segment TU shown in FIG. 3 to the entrance widths, 1.1 to 1.3% Uster Evenness Values, and 12 to 18/50 m peaks at 4 to 10% Uster Evenness Values.

TABLE 1

| Run No. | 1 (Comparative example) | 2 | 3 | 4 | 5 | 6 | 7 (Comparative example) |
|---|---|---|---|---|---|---|---|
| Groove depth | 0.08 | 0.1 | 0.3 | 1.0 | 1.5 | 1.8 | 2.1 |
| L-value | 14.1 | 13.8 | 13.3 | 12.5 | 13.2 | 13.6 | 14.0 |

As shown in Table 1, a depth of color was observed in Run, Nos. 2 to 6 samples of which that of Nos. 3 to 5 was good. The scroopy handle increased with the increase in depth of grooves. No. 2 showed a scroopy handle and No. 3 a distinct scroopy handle. Excellent luster, bulkiness and natural irregularity were almost equal for all the samples.

COMPARATIVE EXAMPLE 1

A drawn yarn substantially without thickness and thinness was obtained by drawing the undrawn yarn of Example 1 at a draw speed of 300 m/min., a hot-pin temperature of 125° C., a hot-plate temperature of 120° C., and a draw-ratio of 1.93. It showed 0.44% Uster Evenness Value, 0 peak at more than 4% Uster Evenness Values, 8 cc/gr. bulkiness degree and 25% elongation. The fabric knitted as Example 1 was subjected to alkaline aqueous solution treatment for obtaining a groove depth equivalent to that of No. 4 of Example 1. The L-value level in depth of color is 13.2, and the knitted fabric had a monotonous appearance and is not bulky despite a scroopy handle and an excellent luster.

EXAMPLE 2

A fabric was knitted of a multifilament yarn made with the quantity of the easily-soluble polymer at the transverse cross-section of the composite fiber of Example 1 fixed at one (Run No. 8 sample, Comparative Example 1) and two (Run No. 9 sample) and subjected to alkaline aqueous solution treatment for obtaining a fiber having grooves with an entrance width of 1.3μ and a depth of 1.0μ and being thick and thin. The ratio of the easily-soluble polymer to the relatively-insoluble polymer of Nos. 8 and 9 samples was fixed however at 5 to 95 and 10 to 95 respectively. No. 8 sample, a thick and thin drawn yarn, showed 35% elongation, substantially no elongation at natural draw zone at S-S curve, 10% shrinkage in boiling water, 20 cc/gr. degree of bulkiness, 1.5% Uster Evenness Value and 25 peaks/50 m at 4 to 10% Uster Evenness Values. No. 9 sample, a thick and thin drawn yarn, showed 34% elongation, substantially no elongation at natural draw zone at curve S-S, 11% shrinkage in boiling water, 21 cc/gr. degree of bulkiness, 1.6% Uster Evenness Value, 27 peaks/50 m at 4 to 10% Uster Evenness Values. No. 8 sample exhibited an L-value of 13.9 and a shortage of scroopy handle while No. 9 a L-value of 12.9 and a distinct scroopy handle. Nos. 8 and 9 samples of the fiber having grooves on the surface had 1.3% and 1.4% Uster Evenness Values and 22 and 25 peaks/50 m at 4–10% Uster Evenness Values, and both their fabrics showed the same excellent luster, bulkiness and natural irregularity as No. 4 sample.

EXAMPLE 3

A 120 denier-24 filament undrawn composite fiber was subjected to spinning, thick and thin drawing, knitting and aqueous alkaline solution treatment so that a fiber having grooves with a depth of 1.0μ on the surface was obtained. Therein the composition ratio of the both component was properly varied for obtaining the entrance width shown in Table 2 the length on the surface of the fiber of the easily-soluble polymer and draw-ratio was fixed at (1+elongation at natural draw zone×1.67). All the thick and thin drawn yarns showed 30 to 34% elongations, substantially no elongation at S-S curve, 10 to 12% shrinkages in boiling water, 19 to 22 cc/gr. degrees of bulkinesses, 1.4 to 1.6% Uster Evenness Values and 22 to 30 peaks/50 m at 4 to 10% Uster Evenness Values. All the fibers having grooves on the surface had 65 to 88% ratios of the line segment TU shown in FIG. 3 to the entrance widths. The color depths observed in Nos. 11 to 17 sample fabrics as shown in Table 2 were good for Nos. 12 to 16 and better for Nos. 13 to 15. Nos. 11 to 17 samples displayed a good scroopy handle, an excellent luster, a bulkiness and a natural irregularity.

TABLE 2

| Run No. | 10 (Comparative Example) | 11 | 12 | 13 | 14 The same as No. 4 | 15 | 16 | 17 | 18 (Comparative Example) |
|---|---|---|---|---|---|---|---|---|---|
| Entrance width (μ) | 0.18 | 0.22 | 0.31 | 0.40 | 1.3 | 2.0 | 2.8 | 3.9 | 4.3 |
| L-value | 14.0 | 13.7 | 13.3 | 12.9 | 12.9 | 12.8 | 13.2 | 13.8 | 14.2 |

EXAMPLE 4

The same thick and thin drawn yarn as Example 1 was obtained by using the undrawn yarn at the draw-ratio shown in Table 3 and subjected to knitting and aqueous alkaline solution treatment. Its characteristics are shown in Table 3. Nos. 24 to 26 samples showed an elongation at natural draw zone at S-S curve and the shrinkages in boiling water of 9 to 15%.

The fibers having grooves with the depths of 0.9 to 1.1μ and the entrance widths of 1.2 to 1.5μ showed such characteristics shown in Table 3. and 72 to 85% ratios of line segment TU to the entrance widths. The scroopy handle, excellent luster, bulkiness and color depth of all Nos. 19 to 26 woven fabrics were good. No. 19 woven fabric showed a slight scroopy handle, No. 20 a gentle scroopy handle, No. 26 with a large Uster Evenness Value an excessive difference of color shade, No. 25 a slightly excessive difference of color shade, and Nos. 21 to 24 a good natural irregularity. Those with the large Uster Evenness Values exhibited the better degrees of bulkiness and the better depths of color.

We claim:

1. A thick and thin fiber comprised of a thermoplastic polymer, said fiber being alternatingly thick and thin along its longitudinal axis and having at least two axially continuous grooves on its surface, each groove having an entrance width of 0.2 to 4μ and a depth of 0.1 to 1.8μ.

2. The thick and thin fiber defined in claim 1, wherein said thermoplastic polymer is a polyester.

3. The thick and thin fiber defined in claim 1 or 2, having a modified cross-sectional shape.

4. The thick and thin fiber defined in claim 3, having a plurality of vertexes, said grooves being present in said vertexes.

5. A thick and thin fiber having grooves on the fiber as defined in claims 1, 2, 3 or 4, having an Uster Evenness Value of 0.7 to 2.5%.

6. The thick and thin fiber as claimed in claim 3, having an Uster Evenness Value of 0.9 to 2.2%.

7. A fabric made of thick and thin fibers having grooves on the fiber surfaces as defined in claims 1, 2, 3, 4, 5, or 6.

* * * * *

| | | Thick and thin composite fiber | | | | | Thick and thin fiber having grooves on the surface | | | |
|---|---|---|---|---|---|---|---|---|---|---|
| | | Uster Evenness Value | Number of Uster Evenness value peaks/50 m | | Degree of bulkiness | Elongation | Uster Evenness Value | Number of Uster Evenness value peaks/50 m | | |
| Run No. | Draw ratio | (%) | 4~10% | Above 10% | (cc/g) | (%) | (%) | 4~10% | Above 10% | L-value |
| 19 | 1.94 | 0.65 | 4 | 0 | 10 | 16 | 0.62 | 2 | 0 | 13.0 |
| 20 | 1.90 | 0.73 | 6 | 0 | 13 | 18 | 0.70 | 5 | 0 | 12.8 |
| 21 | 1.82 | 0.92 | 13 | 0 | 15 | 21 | 0.88 | 10 | 0 | 12.6 |
| 22 | 1.72 | 1.5 | 22 | 3 | 19 | 29 | 1.4 | 19 | 2 | 12.4 |
| 23 | 1.59 | 2.0 | 48 | 8 | 22 | 34 | 1.8 | 45 | 6 | 12.4 |
| 24 | 1.55 | 2.3 | 65 | 13 | 26 | 38 | 2.2 | 58 | 11 | 12.3 |
| 25 | 1.48 | 2.8 | 90 | 18 | 32 | 43 | 2.5 | 76 | 16 | 12.2 |
| 26 | 1.43 | 3.2 | 132 | 22 | 35 | 55 | 3.1 | 103 | 20 | 12.2 |